US012630379B2

(12) United States Patent
Tojo et al.

(10) Patent No.: US 12,630,379 B2
(45) Date of Patent: May 19, 2026

(54) FEEDING SUPPORT APPARATUS, NON-TRANSITORY COMPUTER READABLE MEDIUM STORING FEEDING SUPPORT PROGRAM, AND FEEDING SUPPORT METHOD

(71) Applicant: FUJIFILM Business Innovation Corp., Tokyo (JP)

(72) Inventors: Hiroyuki Tojo, Kanagawa (JP); Takayuki Saito, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 18/190,070

(22) Filed: Mar. 25, 2023

(65) Prior Publication Data

US 2024/0101375 A1 Mar. 28, 2024

(30) Foreign Application Priority Data

Sep. 27, 2022 (JP) ..... 2022-154095

(51) Int. Cl.
*B65H 3/48* (2006.01)
*B65H 7/06* (2006.01)
(Continued)

(52) U.S. Cl.
CPC ..... *B65H 3/48* (2013.01); *B65H 7/06* (2013.01); *B65H 7/12* (2013.01); *B65H 7/16* (2013.01);
(Continued)

(58) Field of Classification Search
CPC ... B65H 3/48; B65H 7/06; B65H 7/12; B65H 7/16; B65H 2511/13; B65H 2511/417;
(Continued)

(56) References Cited

U.S. PATENT DOCUMENTS 8,444,138 B2 5/2013 Taki
2007/0262513 A1* 11/2007 Fukusaka ..... B65H 3/48 271/98

(Continued)

FOREIGN PATENT DOCUMENTS

JP 2010241568 10/2010
JP 2011140359 7/2011
JP 2020070166 5/2020

*Primary Examiner* — Prasad V Gokhale
(74) *Attorney, Agent, or Firm* — JCIPRNET

(57) ABSTRACT

A feeding support apparatus includes a processor configured to: present plural parameters related to blowing conditions of a plural blowing units that support feeding by blowing air to paper accommodated in a paper storing unit; blow air from the plural blowing units based on the plural parameters and perform feeding from the paper storing unit in a case where an instruction for test-feeding based on the plural presented parameters is given; present a correction parameter obtained by correcting at least one of the plural parameters in a case where an error has occurred during feeding from the paper storing unit; and blow air from the plural blowing units based on the correction parameter and perform feeding from the paper storing unit in a case where an instruction for test-feeding based on the presented correction parameter is given.

8 Claims, 6 Drawing Sheets

(51) Int. Cl.
*B65H 7/12* (2006.01)
*B65H 7/16* (2006.01)

(52) U.S. Cl.
CPC .... *B65H 2511/13* (2013.01); *B65H 2511/417* (2013.01); *B65H 2511/515* (2013.01); *B65H 2511/524* (2013.01); *B65H 2511/528* (2013.01); *B65H 2515/10* (2013.01); *B65H 2515/20* (2013.01); *B65H 2515/34* (2013.01); *B65H 2557/63* (2013.01); *B65H 2601/255* (2013.01)

(58) Field of Classification Search
CPC ..... B65H 2511/51; B65H 2511/515; B65H 2511/524; B65H 2511/528; B65H 2515/10; B65H 2515/20; B65H 2515/34; B65H 2557/63; B65H 2601/255
See application file for complete search history.

(56) References Cited

U.S. PATENT DOCUMENTS

| | | | | |
|---|---|---|---|---|
| 2016/0107854 | A1* | 4/2016 | Hashimoto | B65H 7/02 271/97 |
| 2018/0257886 | A1* | 9/2018 | Tsujita | B65H 7/20 |
| 2020/0140215 | A1* | 5/2020 | Ogasawara | B65H 7/16 |
| 2023/0078843 | A1* | 3/2023 | Saito | H04N 1/00588 358/1.12 |

* cited by examiner

FEEDING SUPPORT APPARATUS, NON-TRANSITORY COMPUTER READABLE MEDIUM STORING FEEDING SUPPORT PROGRAM, AND FEEDING SUPPORT METHOD

CROSS-REFERENCE TO RELATED APPLICATIONS

This application is based on and claims priority under 35 USC 119 from Japanese Patent Application No. 2022-154095 filed Sep. 27, 2022.

BACKGROUND

(i) Technical Field

The present invention relates to a feeding support apparatus, a non-transitory computer readable medium storing a feeding support program, and a feeding support method.

(ii) Related Art

JP2020-070166A discloses a feeding parameter management system including a plurality of air feeding apparatuses that include air feeding means for feeding paper through blowing and sticking to the paper and that can switch between feeding parameters for the air feeding means and a management apparatus that is connected to the plurality of air feeding apparatuses by a communication network. In the feeding parameter management system, each of the plurality of air feeding apparatuses includes paper type information acquiring means for acquiring type information of the paper, which is a feeding target, adjusting means for adjusting the feeding parameters for the air feeding means, and transmitting means for transmitting, to the management apparatus, the type information acquired by the paper type information acquiring means, the feeding parameters adjusted by the adjusting means, and a transport result in which the paper, which is the feeding target, is fed using the feeding parameters, and the management apparatus includes parameter management means for storing, in storing means, the type information transmitted from each of the plurality of air feeding apparatuses and an adjustment result in which the feeding parameters and the transport result are associated with each other and setting means for setting, with respect to an air feeding apparatus, which is a processing target, among the plurality of air feeding apparatuses, a feeding parameter corresponding to the type information acquired by the paper type information acquiring means of the air feeding apparatus, which is the processing target, with reference to the adjustment result stored in the storing means based on the transport result corresponding to the feeding parameter.

JP5434601B discloses a feeding apparatus including a paper placing table for placing paper, feeding means for feeding the paper placed on the paper placing table one by one from a top portion, assisting air blowing means for blowing air from any side surface of the side, front, and back of the paper fed from the paper placing table and assisting in feeding, detecting means for detecting behavior of the paper receiving assisting air, and control means for detecting, with the detecting means, the behavior of the paper by operating the assisting air blowing means at a predetermined timing during non-image forming and setting, from the detection result, an optimum air amount of assisting air to be used during image forming, in which the detecting means is detecting means for detecting a height at which the paper floats, and the control means measures, with the detecting means, a height at which the paper reaches within a certain time with an air amount of the assisting air blowing means constant and sets an optimum air amount through the height.

JP2010-241568A discloses a sheet feeding apparatus including sheet placing means, sheet feeding means for feeding sheets placed on the sheet placing means one by one, heat generating means for generating hot air, blowing means for blowing the hot air to the sheet feeding means, sheet feeding state detection means for detecting a feeding state of a sheet fed by the sheet feeding means, and control means that controls an air assisting operation in a blowing state, in which the sheet feeding means sets a first feeding mode for normal feeding and a second feeding mode for preliminary feeding and controls the air assisting operation based on the sheet feeding state detection result during execution of the second feeding mode.

SUMMARY

Aspects of non-limiting embodiments of the present disclosure relate to a feeding support apparatus, a non-transitory computer readable medium storing a feeding support program, and a feeding support method that can easily set parameters related to blowing conditions of a plurality of blowing units that support feeding by blowing air to paper accommodated in a paper storing unit compared to a case of individually setting the parameters of the plurality of blowing units.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a feeding support apparatus including a processor configured to: present a plurality of parameters related to blowing conditions of a plurality of blowing units that support feeding by blowing air to paper accommodated in a paper storing unit; blow air from the plurality of blowing units based on the plurality of parameters and perform feeding from the paper storing unit in a case where an instruction for test-feeding based on the plurality of presented parameters is given; present a correction parameter obtained by correcting at least one of the plurality of parameters in a case where an error has occurred during feeding from the paper storing unit; and blow air from the plurality of blowing units based on the correction parameter and perform feeding from the paper storing unit in a case where an instruction for test-feeding based on the presented correction parameter is given.

BRIEF DESCRIPTION OF THE DRAWINGS

Exemplary embodiment(s) of the present invention will be described in detail based on the following figures, wherein.

DETAILED DESCRIPTION

Hereinafter, an example of an exemplary embodiment for implementing a technique of the present disclosure will be described in detail with reference to the drawings. Components and processing in which operations, workings, and functions perform the same work will be assigned with the same reference signs throughout all the drawings, and overlapping descriptions will be omitted as appropriate in some cases. Each drawing is merely schematically shown to an extent that the technique of the present disclosure can be sufficiently understood. Accordingly, the technique of the present disclosure is not limited to examples shown. In addition, in the present exemplary embodiment, description of a configuration not directly related to the technique of the present disclosure and a well-known configuration will be omitted in some cases.

In the present disclosure, the term "air assisting" refers to a concept of a feeding assisting function of performing paper adjustment in which feeding of paper is assisted in terms of transporting paper through at least one of blowing (for example, supply of a positive pressure gas) or sticking (for example, supply of a gas through negative pressure). In addition, the term "alignment" refers to a concept of a position adjusting function of adjusting the position of paper in terms of transporting paper on which an image is formed at a position determined in advance on the transported paper.

Figure 1:
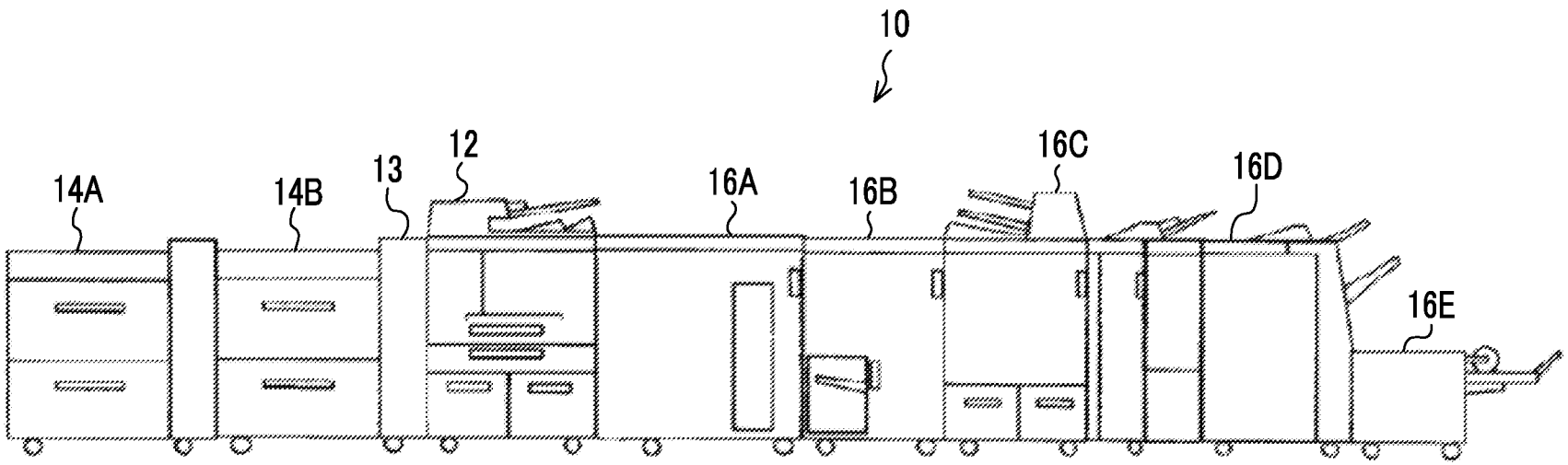
FIG. 1 is a view showing a schematic configuration of an image forming system according to an exemplary embodiment.

FIG. 1 is a view showing a schematic configuration of an image forming system 10 for implementing the technique of the present disclosure.

The image forming system 10 is configured to include an image forming apparatus 12 that includes an image forming unit where an image is formed, a connecting apparatus 13, feeding apparatuses 14A and 14B, and postprocessing apparatuses 16A, 16B, 16C, 16D, and 16E which are finishers.

Each of the feeding apparatus 14A and 14B is a paper feeding apparatus for supplying paper to the image forming apparatus 12. The postprocessing apparatuses 16A, 16B, 16C, 16D, and 16E are apparatuses for discharging paper after performing postprocessing on the paper on which an image is formed by the image forming apparatus 12 and are, for example, apparatuses for performing stapling, punching, paper folding (folding in two and folding in three), gluing, trimming, and the like.

The image forming apparatus 12 is an apparatus for forming (printing) an image on paper by forming the image on an intermediate transfer body based on image data and transferring the image formed on the intermediate transfer body to the paper.

Figure 2:
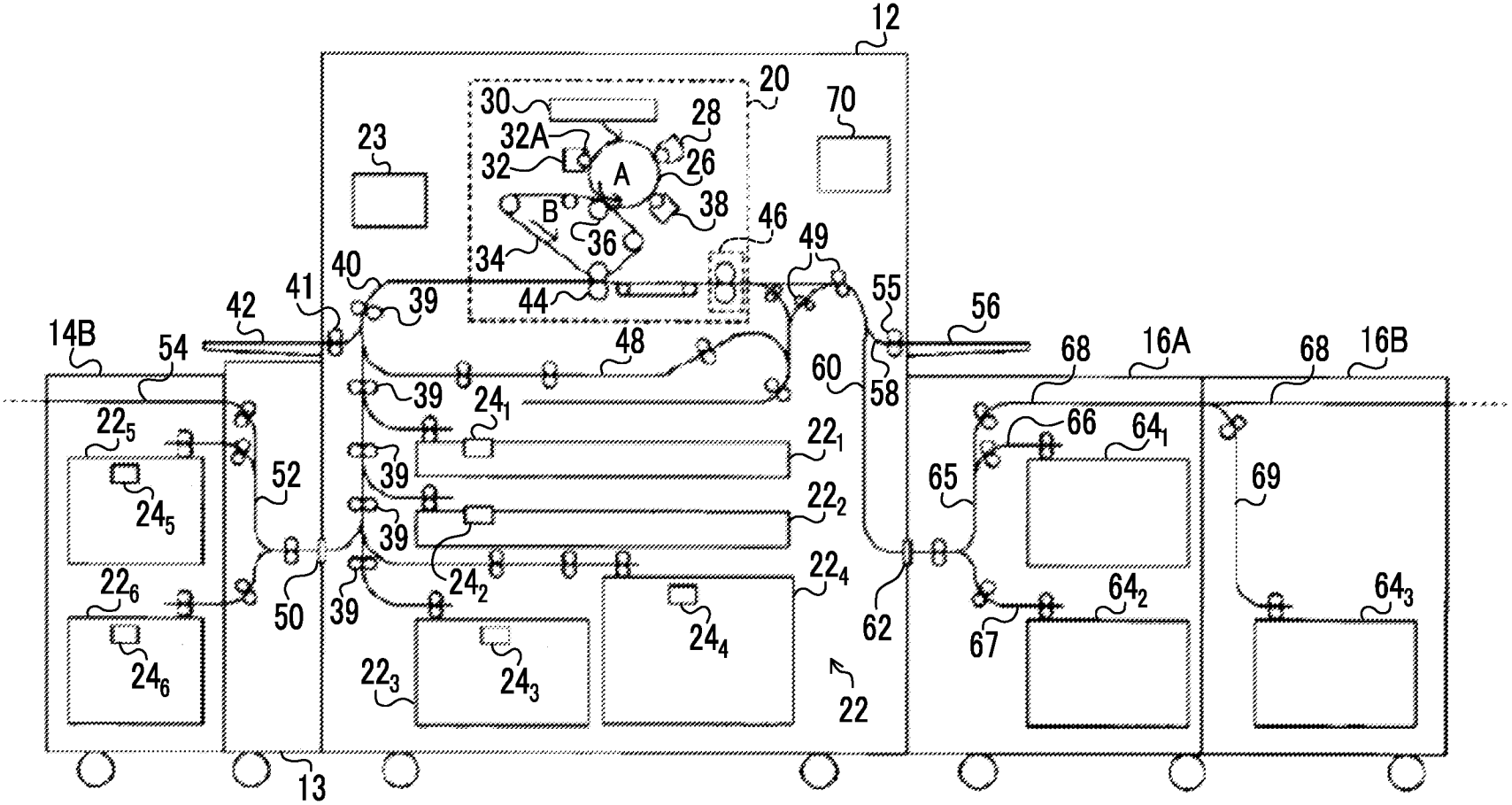
FIG. 2 is a schematic configuration view showing an example of an image forming apparatus of the exemplary embodiment.

FIG. 2 is a schematic configuration view showing an example of the image forming apparatus 12 of the present exemplary embodiment. The image forming apparatus 12 of the present exemplary embodiment is configured to include an image forming unit 20 that forms an image on paper and a paper storing unit 22 for supplying the stored paper to the image forming unit 20.

The paper storing unit 22 is for supplying paper P stored inside to the image forming unit 20. In the present exemplary embodiment, four paper storing units $\mathbf{22}_1$, $\mathbf{22}_2$, $\mathbf{22}_3$, and $\mathbf{22}_4$ are included inside the image forming apparatus 12. In a case of describing each of the paper storing units $\mathbf{22}_1$, $\mathbf{22}_2$, $\mathbf{22}_3$, and $\mathbf{22}_4$ without distinguishing therebetween, the paper storing units $\mathbf{22}_1$, $\mathbf{22}_2$, $\mathbf{22}_3$, and $\mathbf{22}_4$ will be collectively called the paper storing unit 22, and in a case of distinguishing therebetween, the paper storing units $\mathbf{22}_1$, $\mathbf{22}_2$, $\mathbf{22}_3$, and $\mathbf{22}_4$ will be called with the reference signs 1 to 4 assigned.

The paper storing unit 22 can change the size of the stored paper P by adjusting the position of a partitioning member (not shown) or the like inside and stores the stacked paper P. In the present exemplary embodiment, the paper P is stacked and stored on a paper tray (not shown). The paper storing unit 22 drives and lifts up the paper tray on which the paper P is stacked with a motor (not shown) or the like.

The paper storing unit 22 is provided with an air assisting unit 24. The air assisting unit 24 prevents double-feeding of the paper P caused by static electricity, moisture, or the like and supplies a gas such as air to the paper storing unit 22 in order to assist in taking out the paper P. In a case of pulling out the paper from the paper tray to a paper transport path, the air assisting unit 24 blows a gas such as hot air and cold air from a position (for example, a side surface) of a paper bundle stacked on the paper tray, which is determined in advance, and makes a gap between sheets of paper in order to separate out the paper P on an uppermost surface from the paper P thereunder, or keeps the humidity of the stored paper P constant. That is, as air assisting which is assisting processing related to paper transport, processing of blowing a gas from the side surface or the like of the paper bundle and making a gap between sheets of paper, for example, in order to separate out paper on the uppermost surface from paper immediately thereunder in a case of pulling out paper from the paper tray to the transport path is performed by the air assisting unit 24.

Figure 3:
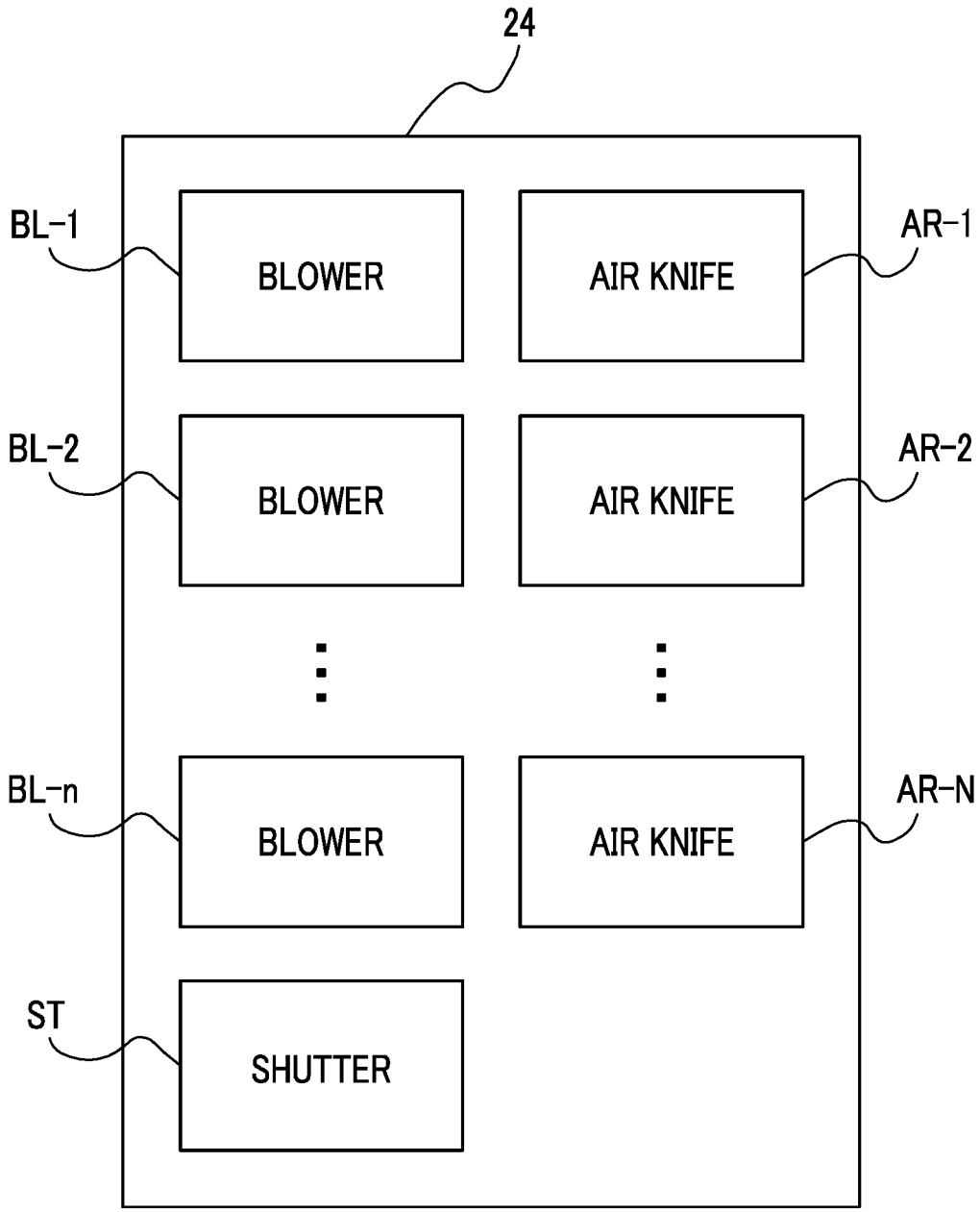
FIG. 3 is a view showing an example of a configuration of an air assisting unit according to the exemplary embodiment.

As shown in FIG. 3, the air assisting unit 24 includes n ($n \geq 1$) blowers BL-1 to BL-n, N ($N \geq 1$) air knives AR-1 to AR-N, and a shutter ST. Although not shown, the blowers BL-1 to BL-n are arranged in the vicinity of the paper tray and have a function of blowing a gas such as air to paper accommodated in the paper tray from various directions and lifting the paper or the like. Although not shown, the air knives AR-1 to AR-N are arranged in the vicinity of the paper tray and have a function of blowing a gas such as air to the paper accommodated in the paper tray from various directions and separating out overlapping sheets of paper one by one such that the paper is fed one by one. As described above, the blowers BL-1 to BL-n and the air knives AR-1 to AR-N function as a plurality of blowing units that support feeding by blowing air to the paper accommodated in the paper storing unit 22.

A gas supplied by the air assisting unit 24 is not limited to air and may be any gas, but in order to simplify the following description, a case where air is supplied will be described.

The paper P taken out from the paper P on the uppermost surface, which is stacked on the paper tray, is transported to the image forming unit 20 by a plurality of pairs of rollers 39 by a paper transport path 40.

In addition, the image forming apparatus 12 is provided with a manual feed tray 42 for manually bringing in the paper P. The paper P placed on the manual feed tray 42 is guided onto the paper transport path 40 by a manual roller 41 and the pairs of rollers 39 inside the image forming apparatus 12 and is transported to the image forming unit 20 by the paper transport path 40.

In addition, a paper receiving port 50 for receiving the paper P supplied from the feeding apparatus 14 is provided on a lower side of the manual feed tray 42 in the image forming apparatus 12 of the present exemplary embodiment. The paper P received from the paper receiving port 50 is transported to the image forming unit 20 by the paper transport path 40.

The image forming apparatus 12 of the present exemplary embodiment is provided with an alignment unit 23 that adjusts the position of the paper P transported to the image forming unit 20 by the paper transport path 40. Since the alignment unit 23 reduces misalignment of an image with respect to paper, which occurs due to unstable transportation of the paper such as slippage and skewing of the paper during transportation, the alignment unit 23 adjusts the position of the transported paper after paper supply. As alignment of adjusting the position of the paper P, for example, at least one of offset adjustment or skew adjustment is applied to the alignment unit 23. In the offset adjustment, adjustment of shifting the position of paper by a distance determined in advance in at least one direction of a transport direction with respect to a reference position of the paper during transportation, an opposite transport direction, or a direction (for example, a right-left direction) intersecting the transport direction is applied to paper during transportation. In addition, in the skew adjustment, adjustment of rotating paper from an angle formed by the transport direction of paper before adjustment and a longitudinal direction of paper by an angle determined in advance is applied.

The image forming unit 20 is configured to include a photoreceptor 26, a charger 28, a light beam scanning device 30, a developer 32, an intermediate transfer body 34, a transfer device 36, a static eliminator and cleaner 38, a transfer device 44, and a fixer 46.

The photoreceptor 26 rotates in an opposite direction to an arrow A direction at a speed determined in advance. The charger 28 for charging a peripheral surface is provided in the vicinity of the photoreceptor 26. The light beam scanning device 30 irradiates the peripheral surface of the photoreceptor 26 charged by the charger 28 with a light beam based on image data and forms an electrostatic latent image. The developer 32 includes a roller 32A and attaches a toner stored inside to the electrostatic latent image formed on the peripheral surface of the photoreceptor 26 with the roller 32A to perform development.

The intermediate transfer body 34 is an endless belt provided at a lower portion of the photoreceptor 26 and rotates in an arrow B direction at the same rotation speed as the rotation speed of the photoreceptor 26 due to a plurality of rollers. The transfer device 36 is disposed at a position where the photoreceptor 26 and the intermediate transfer body 34 come into contact with each other. A toner image on the peripheral surface of the photoreceptor 26 is transferred to the intermediate transfer body 34. The static eliminator and cleaner 38 has a function of removing static electricity from the peripheral surface of the photoreceptor 26 and a function of removing a residual toner remaining on the peripheral surface.

Meanwhile, the paper P transported by the paper transport path 40 is sent between the intermediate transfer body 34 and the transfer device 44, and a toner image on the intermediate transfer body 34 is transferred by the transfer device 44. The paper P to which the toner image is transferred is discharged to the outside of the image forming apparatus 12 by a pair of discharge rollers 49 after a toner is melted and fixed by the fixer 46.

The image forming apparatus 12 is provided with a discharge tray 56 for discharging the paper P on which an image is formed. The paper P on which the image is formed is discharged to the discharge tray 56 by a paper transport path 58 by the pair of discharge rollers 49 and a discharge roller 55 inside the image forming apparatus 12. In addition, a paper discharge port 62 for discharging the paper P to the postprocessing apparatus 16 is provided on the lower side of the discharge tray 56 in the image forming apparatus 12 of the present exemplary embodiment. In a case of discharging the paper P on which the image is formed to the postprocessing apparatus 16, the paper P is transported from the paper discharge port 62 to the postprocessing apparatus 16A by a paper transport path 60.

In addition, the image forming apparatus 12 includes an inverting passage 48 for two-sided printing, the paper P having one side on which an image is formed is inverted at the inverting passage 48 and is transported again to the intermediate transfer body 34, and the image is transferred thereto.

Further, the feeding apparatuses 14A (not shown) and 14B are connected to the image forming apparatus 12 by the connecting apparatus 13. A paper supply port (the paper receiving port 50 of the image forming apparatus 12) is provided in the connecting apparatus 13.

The feeding apparatus 14B of the present exemplary embodiment is configured to include two paper storing units 22 (paper storing units $\mathbf{22}_5$ and $\mathbf{22}_6$). The paper storing unit 22 of the feeding apparatus 14B has substantially the same configuration as the paper storing unit 22 inside the image forming apparatus 12, and the taken out paper P is received by the image forming apparatus 12 from the paper supply port (common to the paper receiving port 50) by a paper transport path 52 and is supplied to the image forming unit 20.

The feeding apparatus 14A (not shown) is configured substantially the same as the feeding apparatus 14B, and the paper P transported from the feeding apparatus 14A is received by the image forming apparatus 12 from the paper supply port (paper receiving port 50) by a paper transport path 54 and is supplied to the image forming unit 20.

Further, the postprocessing apparatuses 16A, 16B, 16C, 16D, and 16E (16C to 16D are not shown), which are finishers, are connected to the image forming apparatus 12. The postprocessing apparatus 16A is provided with the paper receiving port 50 corresponding to the paper discharge port 62 of the image forming apparatus 12.

The postprocessing apparatus 16A of the present exemplary embodiment is configured to include two paper discharge units 64 (paper discharge units $\mathbf{64}_1$ and $\mathbf{64}_2$). The paper P on which an image is formed is received by the postprocessing apparatus 16A from the paper receiving port (paper discharge port) 62 and is discharged to the paper discharge unit $\mathbf{64}_1$ by a paper transport path 66. In addition, the paper P is discharged to the paper discharge unit $\mathbf{64}_2$ by a paper transport path 67. Further, the paper P is transported to the postprocessing apparatus 16B by a paper transport path 68.

The postprocessing apparatus 16B is configured to include one paper discharge unit 64 (paper discharge unit $\mathbf{64}_3$). The paper P on which an image is formed is discharged to the paper discharge unit $\mathbf{64}_3$ by a paper transport path 69. In addition, the paper P is transported to the postprocessing apparatuses 16C to 16E by the paper transport path 68.

The postprocessing apparatuses 16C to 16E (not shown) include each paper discharge unit 64 and each paper transport path corresponding thereto, substantially like the postprocessing apparatuses 16A and 16B. The paper P transported by the paper transport path 68 is discharged to the corresponding paper discharge unit 64 by the paper transport path.

Although the image forming apparatus 12 can perform feeding support processing of supporting (air assisting) paper feeding related to paper transportation and position adjustment processing of adjusting (aligning) the position of the paper for forming an image at a position determined in advance on the transported paper, the feeding support processing will be described, and description of the position adjustment processing will be omitted in the present exemplary embodiment.

Figure 4:
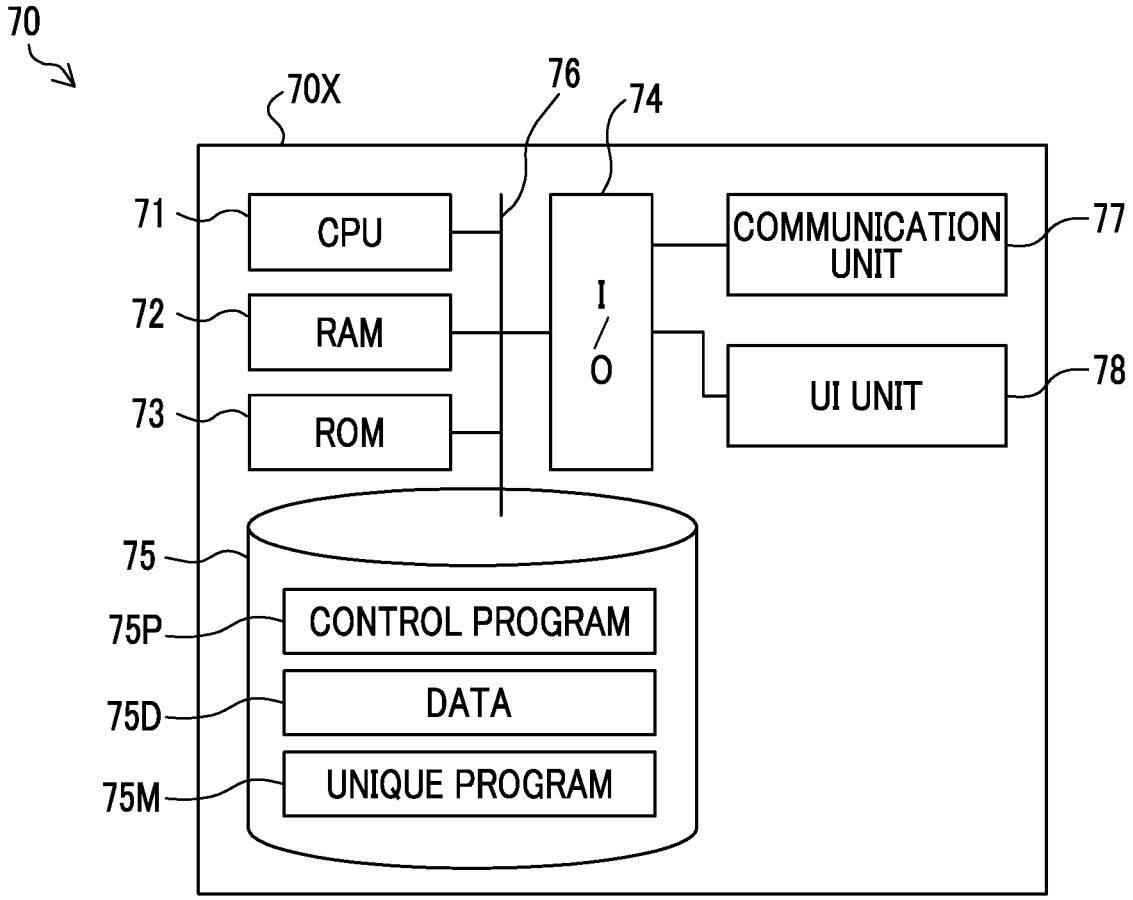
FIG. 4 is a view showing an example of an electrical configuration of the image forming apparatus according to the exemplary embodiment.

Next, an example of an electrical configuration of the image forming apparatus 12 will be described with reference to FIG. 4. The image forming apparatus 12 can be realized by a configuration including a general-purpose computer apparatus such as a server and a personal computer (PC).

The image forming apparatus 12 includes a control unit 70 that performs overall control, and the control unit 70 includes a computer body 70X. The computer body 70X includes a central processing unit (CPU) 71, a random access memory (RAM) 72, a read-only memory (ROM) 73, and an input and output port (I/O) 74, and these units are connected to each other by a bus 76. As an auxiliary storage device that can be realized by a hard disk drive (HDD), a non-volatile flash memory, and the like, a storage unit 75 is connected to the bus 76. In addition, a communication unit 77 and a user interface (UI) unit 78 which is an operation unit including a display device such as a touch panel are also connected to the I/O 74. Various types of data 75D used by the image forming apparatus 12 are stored in the storage unit 75. In the present exemplary embodiment, a case where the data 75D is recommended value data 75D to be described later will be described.

The control unit 70 is an example of the feeding support apparatus according to the exemplary example of the present disclosure.

The communication unit 77 is connected to each of the units configuring the image forming apparatus 12, which are related to image forming described above, and can receive data and commands such that each unit of the image forming apparatus 12 can be controlled. In addition, the communication unit 77 is configured to be capable of communicating with an external apparatus. In addition, a unique program 75M for realizing various types of functions of each of the units of the image forming apparatus 12, which are related to image forming, is also stored in the storage unit 75. The CPU 71 executes processing by reading the unique program 75M from the storage unit 75 and developing the unique program 75M in the RAM 72. Accordingly, the image forming apparatus 12 which has executed the unique program 75M operates such that various types of the functions related to image forming described above can be executed.

A control program 75P for performing feeding support processing related to paper feeding support to be described later is stored in the storage unit 75. The control program 75P is an example of a feeding support program. The CPU 71 executes processing by reading the control program 75P from the storage unit 75 and developing the control program 75P in the RAM 72. Accordingly, the computer body 70X which has executed the control program 75P operates as the control unit 70. The control program 75P may be provided by a recording medium such as a CD-ROM.

The image forming apparatus 12 can set various types of parameters related to feeding. Specifically, the control unit 70 displays a setting screen 80 on the UI unit 78 as shown in FIG. 5 and receives setting of various types of parameters related to air assisting by an operator.

Figure 5:
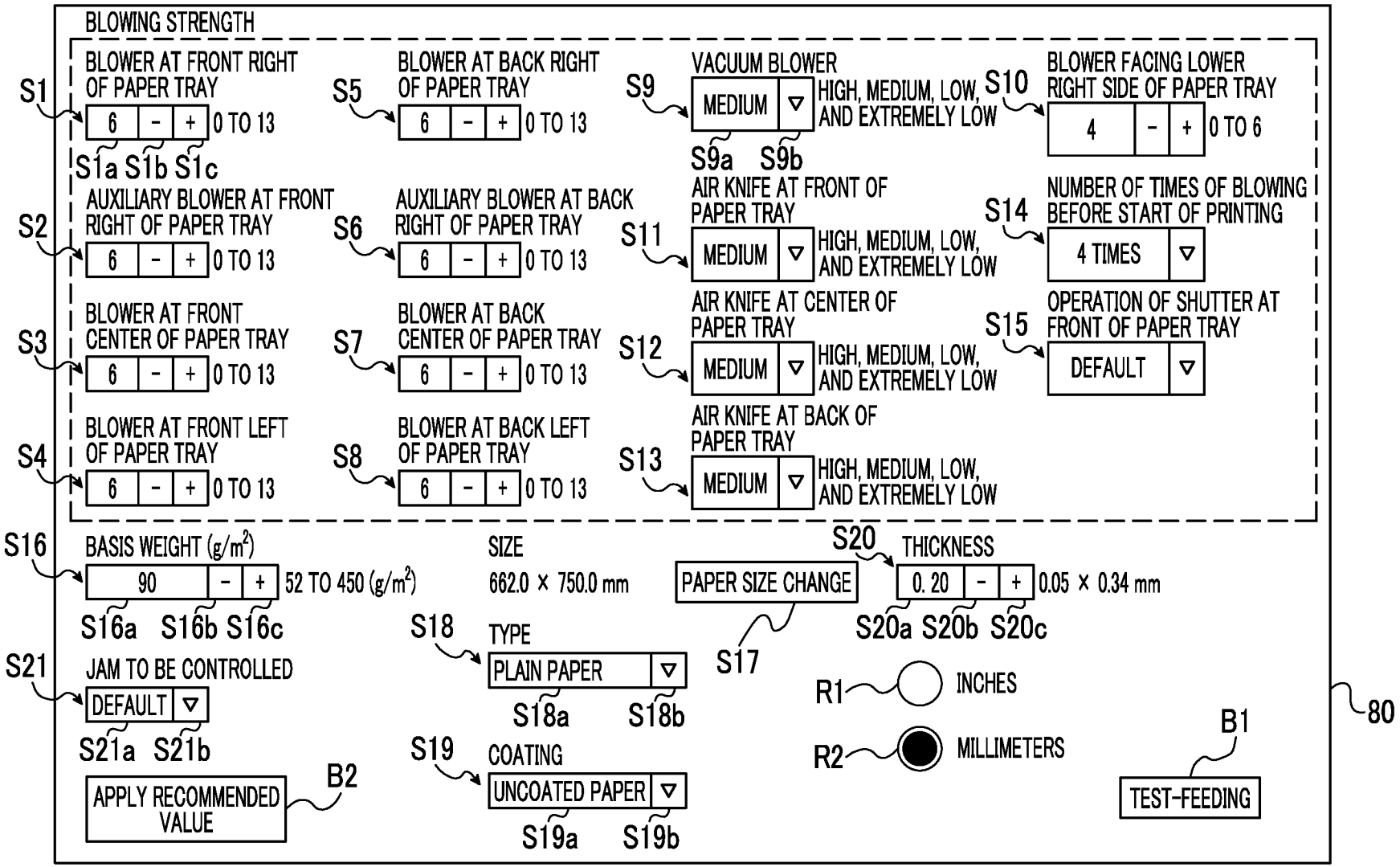
FIG. 5 is a view showing an example of a setting screen according to the exemplary embodiment.

As shown in FIG. 5, the setting screen 80 is provided with setting fields S1 to S15 for setting a plurality of parameters related to blowing conditions of each blowing unit of the air assisting unit 24.

The setting field S1 is a field for setting blowing strength of the blower BL-1 at the front right of the paper tray and is configured by a display field S1*a*, a – button S1*b*, and a + button S1*c* for blowing strength. In the example of FIG. 5, the blowing strength can be set, for example, within a range of 0 to 13, and the blowing strength is set to "6". Then, in a case where the + button S1*c* is pressed, the blowing strength increases, and in a case where the – button S1*b* is pressed, the blowing strength decreases.

In addition, the setting field S2 is a field for setting the blowing strength of the auxiliary blower BL-2 at the front right of the paper tray and has the same setting method of the blowing strength as in the setting field S1. Similarly, in the following, the setting field S3 is a field for setting the blowing strength of the blower BL-3 at the front center of the paper tray. The setting field S4 is a field for setting the blowing strength of the blower BL-4 at the front left of the paper tray. The setting field S5 is a field for setting the blowing strength of the blower BL-5 at the back right of the paper tray. The setting field S6 is a field for setting the blowing strength of the auxiliary blower BL-6 at the back right of the paper tray. The setting field S7 is a field for setting the blowing strength of the auxiliary blower BL-7 at the back center of the paper tray. The setting field S8 is a field for setting the blowing strength of the auxiliary blower BL-8 at the back left of the paper tray.

The setting field S9 is a field for setting the blowing strength of the vacuum blower BL-9 and is configured by a display field S9*a* for displaying the blowing strength and a pull-down button S9*b*. In the example of FIG. 5, the blowing strength can be set, for example, in four stages including high, medium, low, and extremely low, and the blowing strength is set to "medium". In a case where the pull-down button S9*b* is pressed, the four stages of blowing strength are displayed, and appropriate blowing strength can be set from the four stages.

The setting field S10 is a field for setting the blowing strength of the blower BL-10 facing a lower right side of the paper tray and is the same as the setting fields S1 to S8 except that the blowing strength can be set in a range of 0 to 6.

The setting field S11 is a field for setting the blowing strength of the air knife AR-1 at the front of the paper tray, and four stages of blowing strength can be set as in the vacuum blower BL-9. Similarly, in the following, the setting field S12 is a field for setting the blowing strength of the air knife AR-2 at the center of the paper tray. The setting field S13 is a field for setting the blowing strength of the air knife AR-3 at the back of the paper tray.

The setting field S14 is a field for setting the number of times of blowing before the start of printing.

The setting field S15 is a field for setting an operation of a shutter (not shown) at the front of the paper tray and can be set to "default", "double-feeding correction High", "double-feeding correction Mid", "double-feeding correction Low", "misfeed correction High", "misfeed correction Mid", and "misfeed correction Low". The default is an initial value kept inside the image forming apparatus 12.

In addition, the setting screen 80 is provided with setting fields S16 to S20 for setting a plurality of parameters related to characteristics of paper. The characteristics of paper includes at least one of the basis weight of paper, the size of paper, the type of paper, the presence or absence of coating of paper, or the thickness of paper, but a case where all are included will be described in the present exemplary embodiment.

The setting field S16 is a field for setting the basis weight ($g/m^2$) of paper and is configured by a display field S16*a* for displaying the basis weight, a – button S16*b*, and a + button S16*c*. In the example of FIG. 5, the basis weight can be set, for example, within a range of 52 to 450 ($g/m^2$), and the basis weight is set to "90". Then, in a case where the + button S16*c* is pressed, the basis weight increases, and in a case where the – button S16*b* is pressed, the basis weight decreases.

The setting field S17 is a field for setting the size of paper, and an appropriate size of paper can be set from sizes of a plurality of types of paper determined in advance by pressing the setting field S17.

The setting field S18 is a field for setting the type of paper and is configured by a display field S18*a* for displaying the type of paper and a pull-down button S18*b*. By pressing the pull-down button S18*b*, an appropriate type of paper can be set from a plurality of types of paper including plain paper and glossy paper.

The setting field S19 is a field for setting the presence or absence of coating of paper and is configured by a display field S19*a* for displaying the type of coating of paper and a pull-down button S19*b*. By pressing the pull-down button S19*b*, it is possible to set whether coated paper is used or uncoated paper is used.

The setting field S20 is a field for setting the thickness of paper and is configured by a display field S20*a* for displaying the thickness, a – button S20*b*, and a + button S20*c*. The thickness can be increased by pressing the + button S20*c*, and the thickness can be decreased by pressing the – button S20*b*. The unit of the size of the thickness can be set to inches by pressing a radio button R1, and the unit of the size of the thickness can be set to millimeters by pressing a radio button R2.

The setting field S21 is a field for setting the type of jam to be suppressed, that is, the type of error to be suppressed during feeding and is configured by a display field S21*a* for displaying the type of jam to be suppressed and a pull-down button S21*b*. The type of error includes at least one of a misfeed jam or double-feeding, but a case where the type of error includes both of the misfeed jam and double-feeding will be described in the present exemplary embodiment. In the present exemplary embodiment, by pressing the pull-down button S21*b*, it is possible to set, for example, from three types including "default", "misfeed jam", and "double-feeding". Herein, the term "default" means no error, that is, an error such as a misfeed jam has not occurred during feeding. The term "misfeed jam" means an error in which feeding is not performed from the paper tray. The term "double-feeding" means an error in which a plurality of sheets of paper are fed while overlapping each other.

The operator sets various types of parameters in the setting fields S1 to S20 as pre-setting for printing and performs test-feeding by pressing a test-feeding button B1. Then, in a case where an error such as a misfeed jam has occurred, at least one parameter of the parameters set in the setting fields S1 to S15 for setting various types of parameters related to air assisting is changed, and test-feeding can be performed again. Then, in a case where no error has occurred, the actual printing is performed. The various types of parameters in a case where the actual printing has been performed are stored in the storage unit 75 as the recommended value data 75D. Then, in a case where the operator presses a recommended value application button B2, the control unit 70 reads the recommended value data 75D from the storage unit 75 to display the various types of parameters in the setting fields S1 to S15 and presents to the operator.

Herein, in a case where an error has occurred, it is complicated for the operator to set various types of parameters related to air assisting. For this reason, in the present exemplary embodiment, in a case where an error has occurred during test-feeding, correction parameters obtained by correcting at least one of various types of parameters related to air assisting are presented in the setting fields S1 to S15.

Correction parameters are calculated through a calculation formula determined in advance. For example, the calculation formula is a calculation formula for calculating, as correction parameters, parameters different from various types of parameters related to air assisting in a case where an error has occurred in the past, based on the various types of parameters related to air assisting in a case where the error has occurred in the past.

Then, in a case where an instruction for test-feeding based on the correction parameters is given, air is blown from the blowers BL1 to BL10 and the air knives AR1 to AR3 based on the correction parameters, and feeding from the paper storing unit 22 is performed. Then, in a case where no error has occurred, the various types of parameters related to air assisting are stored in the storage unit 75 as the recommended value data 75D. The recommended value data 75D is stored for each parameter related to the type of paper. That is, the recommended value data 75D is stored in the storage unit 75 for each of the parameters set in the setting fields S16 to S20.

As described above, in a case where an error has occurred in test-feeding, it is not necessary for the operator to reset parameters each time since correction parameters are presented. For this reason, various types of parameters related to air assisting may be easily set compared to a case of individually setting various types of parameters related to air assisting.

Next, feeding support processing performed by the image forming apparatus 12 of the present exemplary embodiment will be described in detail.

In the image forming apparatus 12, the entire image forming apparatus 12 is controlled by the control unit 70. In the present exemplary embodiment, in a case of performing image forming processing by the image forming apparatus 12, since the amount of work required for setting various types of parameters related to air assisting is reduced, setting of various types of parameters in test-feeding is supported by presenting correction parameters obtained by correcting various types of parameters.

Figure 6:
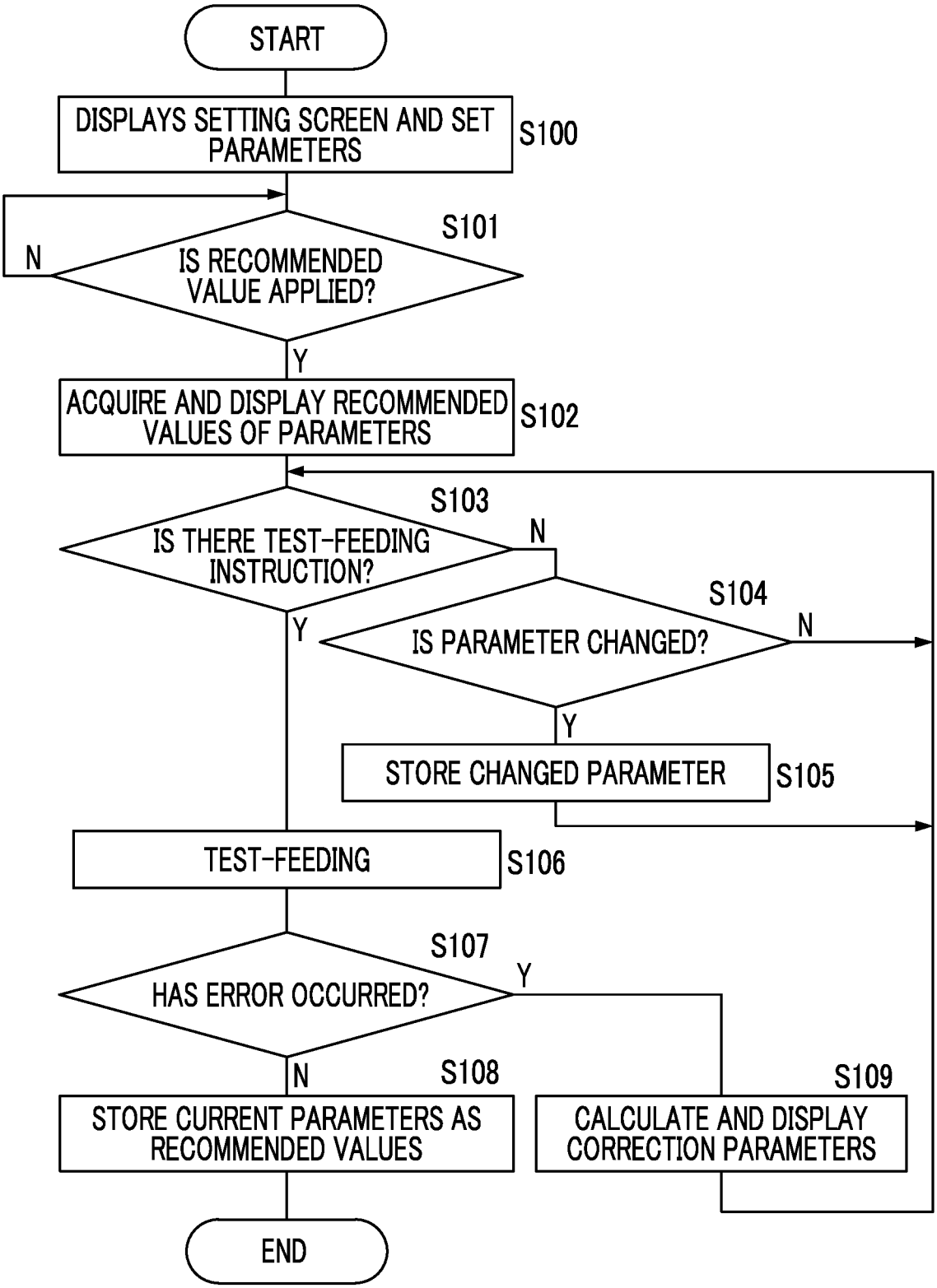
FIG. 6 is a flowchart showing an example of feeding support processing according to the exemplary embodiment.

FIG. 6 is a flowchart showing an example of feeding support processing of supporting setting of various types of parameters related to air assisting in the image forming apparatus 12. The feeding support processing shown in FIG. 6 is performed before image forming. In a case where an instruction for test-feeding is received from the operator by the UI unit 78, control processing shown in FIG. 6 is executed as the CPU 71 reads the control program 75P from the storage unit 75.

In Step S100, the CPU 71 displays the setting screen 80 shown in FIG. 5 on the UI unit 78 and causes the operator to set a plurality of parameters related to characteristics of paper to be subjected to test-feeding. That is, the operator is caused to set each of parameters in the setting fields S16 to S20 for setting the plurality of parameters related to characteristics of paper. The operator sets each of the parameters in the setting fields S16 to S20 and presses the recommended value application button B2.

In Step S101, the CPU 71 determines whether or not the recommended value application button B2 is pressed. Then, in a case where the recommended value application button B2 is pressed, processing proceeds to Step S102, and in a case where the recommended value application button B2 is not pressed, the processing stands by until the recommended value application button B2 is pressed.

In Step S102, the CPU 71 reads the recommended value data 75D corresponding to each of the parameters related to characteristics of paper, which are set in the setting fields S16 to S20, from the storage unit 75 and displays in the setting fields S1 to S15. In a case where the recommended value data 75D is yet to be stored in the storage unit 75, parameters determined in advance are displayed in the setting fields S1 to S15 as the recommended value data 75D.

In Step S103, the CPU 71 determines whether or not an instruction for test-feeding is given, that is, whether or not the test-feeding button B1 is pressed. Then, in a case where the test-feeding button B1 is pressed, processing proceeds to Step S106, and in a case where the test-feeding button B1 is not pressed, processing proceeds to Step S104.

In Step S104, the CPU 71 determines whether or not at least one of the parameters displayed in the setting fields S1 to S15 is changed. Then, in a case where at least one of the parameters displayed in the setting fields S1 to S15 is changed, processing proceeds to Step S105, and in a case where none of the parameters displayed in the setting fields S1 to S15 is changed, processing proceeds to Step S103.

In Step S105, the CPU 71 stores the changed parameters in the storage unit 75.

In Step S106, the CPU 71 performs control such that paper corresponding to characteristics of paper, which are set in the setting fields S16 to S20, is fed from the accommodated paper storing unit 22. In this case, the blowers BL-1 to BL-10, the air knives AR-1 to AR-3, and the shutter ST of the air assisting unit 24 are controlled in accordance with the parameters set in the setting fields S1 to S15.

In Step S107, the CPU 71 determines whether or not an error has occurred in test-feeding performed in Step S106. That is, whether or not a misfeed jam or double-feeding has occurred is determined. Then, in a case where none of the misfeed jam and double-feeding has occurred, processing proceeds to Step S108, and in a case where the misfeed jam or double-feeding has occurred, processing proceeds to Step S109.

In Step S108, the CPU 71 stores each of the parameters set in the setting fields S1 to S15 in the storage unit 75 as the recommended value data 75D.

In Step S109, the CPU 71 calculates correction parameters obtained by correcting the parameters set in the setting fields S1 to S15 to correspond to the type of the occurred error, using the calculation formula determined in advance, and displays the calculated correction parameters in the setting fields S1 to S15.

As described above, in the present exemplary embodiment, in a case where a plurality of parameters related to blowing conditions of the plurality of blowing units of the air assisting unit 24 that supports feeding by blowing air to paper accommodated in the paper storing unit 22 are presented and an instruction for test-feeding based on the plurality of presented parameters is given, air is blown from the plurality of blowing units based on the plurality of parameters, in a case where feeding from the paper storing unit 22 is performed and an error has occurred during feeding from the paper storing unit 22, correction parameters obtained by correcting at least one of the plurality of parameters are presented, in a case where an instruction for test-feeding based on the presented correction parameters is given, air is blown from the plurality of blowing units based on the correction parameters, and feeding from the paper storing unit 22 is performed. Then, such processing is repeated until no error occurs. Accordingly, compared to a case of individually setting parameters related to blowing conditions of the plurality of blowing units that support feeding by blowing air to paper accommodated in the paper storing unit 22, the parameters of the plurality of blowing units may be easily set.

Although the image forming apparatus 12 including the intermediate transfer body has been described in detail in the present exemplary embodiment, without being limited thereto, for example, a tandem type image forming apparatus that does not include the intermediate transfer body or the like may be adopted. In addition, although the image forming apparatus 12 that forms an electrostatic latent image (image) with a light beam has been described in detail in the present exemplary embodiment, without being limited thereto, for example, an inkjet type image forming apparatus that does not use a light beam or the like may be adopted.

OTHER FORMS

Although the technique of the present disclosure has been described in detail in the above description based on a certain exemplary embodiment of the present disclosure, the technique of the present disclosure is not limited to such an exemplary embodiment and can take other various exemplary embodiments within the scope of the technique of the present disclosure.

In addition, although processing performed by executing a program stored in the storage unit has been described in the exemplary embodiment, processing of the program may be realized by hardware.

Further, processing of the exemplary embodiment may be stored and distributed as a program in a storage medium such as an optical disk.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The following will be further disclosed with respect to the above exemplary embodiment.

(((1)))

A feeding support apparatus comprising:

a processor configured to:

present a plurality of parameters related to blowing conditions of a plurality of blowing units that support feeding by blowing air to paper accommodated in a paper storing unit;

blow air from the plurality of blowing units based on the plurality of parameters and perform feeding from the paper storing unit in a case where an instruction for test-feeding based on the plurality of presented parameters is given;

present a correction parameter obtained by correcting at least one of the plurality of parameters in a case where an error has occurred during feeding from the paper storing unit; and blow air from the plurality of blowing units based on the correction parameter and perform feeding from the paper storing unit in a case where an instruction for test-feeding based on the presented correction parameter is given.

(((2)))

The feeding support apparatus according to (((1))), wherein the processor is configured to:

store the parameters in a storage unit in a case where no error has occurred and present the parameters stored in the storage unit as recommended values.

(((3)))

The feeding support apparatus according to (((1))) or (((2))), wherein the processor is configured to:

correct the parameters depending on a type of the error.

(((4)))

The feeding support apparatus according to (((3))), wherein the type of the error includes at least one of a misfeed jam or double-feeding.

(((5)))

The feeding support apparatus according to any one of (((1))) to (((4))), wherein the processor is configured to:

correct the parameters depending on a characteristic of the paper.

(((6)))

The feeding support apparatus according to (((5))), wherein the characteristic of the paper includes at least one of a basis weight of the paper, a size of the paper, a type of the paper, presence or absence of coating of the paper, or a thickness of the paper.

(((7)))

A feeding support program causing a computer to execute a process comprising:

presenting a plurality of parameters related to blowing conditions of a plurality of blowing units that support feeding by blowing air to paper accommodated in a feeding apparatus;

blowing air from the plurality of blowing units based on the plurality of parameters and performing feeding from the feeding apparatus in a case where an instruction for test-feeding based on the plurality of presented parameters is given;

presenting a plurality of correction parameters obtained by correcting each of the plurality of parameters in a case where an error has occurred during feeding from the feeding apparatus; and blowing air from the plurality of blowing units based on the plurality of correction parameters and performing feeding from the feeding apparatus in a case where an instruction for test-feeding based on the plurality of presented correction parameters is given.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A feeding support apparatus comprising:

a processor configured to:

present a plurality of parameters related to blowing conditions of a plurality of blowing units that support feeding by blowing air to paper accommodated in a paper storing unit;

blow air from the plurality of blowing units based on the plurality of parameters and perform feeding from the paper storing unit in a case where an instruction for test-feeding based on the plurality of presented parameters is given;

present a correction parameter calculated and obtained by correcting at least one of the plurality of parameters using a predetermined calculation formula in a case where an error has occurred during feeding from the paper storing unit; and blow air from the plurality of blowing units based on the correction parameter and perform feeding from the paper storing unit in a case where an instruction for test-feeding based on the presented correction parameter is given.

2. The feeding support apparatus according to claim 1, wherein the processor is configured to:

store the parameters in a storage unit in a case where no error has occurred and present the parameters stored in the storage unit as recommended values.

3. The feeding support apparatus according to claim 1, wherein the processor is configured to:

correct the parameters depending on a type of the error.

4. The feeding support apparatus according to claim 3, wherein the type of the error includes at least one of a misfeed jam or double-feeding.

5. The feeding support apparatus according to claim 1, wherein the processor is configured to:

correct the parameters depending on a characteristic of the paper.

6. The feeding support apparatus according to claim 5, wherein the characteristic of the paper includes at least one of a basis weight of the paper, a size of the paper, a type of the paper, presence or absence of coating of the paper, or a thickness of the paper.

7. A non-transitory computer readable medium storing a feeding support program causing a computer to execute a process comprising:

presenting a plurality of parameters related to blowing conditions of a plurality of blowing units that support feeding by blowing air to paper accommodated in a feeding apparatus;

blowing air from the plurality of blowing units based on the plurality of parameters and performing feeding from the feeding apparatus in a case where an instruction for test-feeding based on the plurality of presented parameters is given;

presenting a plurality of correction parameters calculated and obtained by correcting each of the plurality of parameters using a predetermined calculation formula in a case where an error has occurred during feeding from the feeding apparatus; and blowing air from the plurality of blowing units based on the plurality of correction parameters and performing feeding from the feeding apparatus in a case where an instruction for test-feeding based on the plurality of presented correction parameters is given.

8. A feeding support method comprising:

presenting a plurality of parameters related to blowing conditions of a plurality of blowing units that support feeding by blowing air to paper accommodated in a feeding apparatus;

blowing air from the plurality of blowing units based on the plurality of parameters and performing feeding from the feeding apparatus in a case where an instruction for test-feeding based on the plurality of presented parameters is given;

presenting a plurality of correction parameters calculated and obtained by correcting each of the plurality of parameters using a predetermined calculation formula in a case where an error has occurred during feeding from the feeding apparatus; and blowing air from the plurality of blowing units based on the plurality of correction parameters and performing feeding from the feeding apparatus in a case where an instruction for test-feeding based on the plurality of presented correction parameters is given.

* * * * *